US009252521B1

(12) United States Patent
Beaman et al.

(10) Patent No.: US 9,252,521 B1
(45) Date of Patent: Feb. 2, 2016

(54) SHORT PATH CIRCUIT CARD

(71) Applicant: LENOVO ENTERPRISE SOLUTIONS (SINGAPORE) PTE. LTD., New Tech Park (SG)

(72) Inventors: Brian S. Beaman, Apex, NC (US); Wen-Hsin Chen, New Taipei (TW)

(73) Assignee: Lenovo Enterprise Solutions (Singapore) PTE. LTD., New Tech Park (SG)

( * ) Notice: Subject to any disclaimer, the term of this patent is extended or adjusted under 35 U.S.C. 154(b) by 0 days.

(21) Appl. No.: 14/450,551

(22) Filed: Aug. 4, 2014

(51) Int. Cl.
*H01R 29/00* (2006.01)
*H01R 13/24* (2006.01)

(52) U.S. Cl.
CPC ..... *H01R 13/2435* (2013.01)

(58) Field of Classification Search
CPC ..... H01R 9/096; H01R 23/72; H01R 23/7084
USPC ..... 439/50, 65, 67; 257/686; 361/785
See application file for complete search history.

(56) References Cited

U.S. PATENT DOCUMENTS 6,709,277 B2 3/2004 Ruttan et al.
6,713,854 B1 * 3/2004 Kledzik ..... H05K 1/141 174/252
6,752,635 B1 6/2004 Searls et al.
6,971,887 B1 * 12/2005 Trobough ..... H05K 7/1092 439/71
7,248,481 B2 * 7/2007 Trobough ..... H05K 7/1061 361/785
7,517,228 B2 * 4/2009 Baskaran ..... H05K 1/147 439/67
8,450,201 B2 * 5/2013 Braunisch ..... H01L 25/0657 257/693
2002/0137369 A1 9/2002 Edwards et al.
2002/0164894 A1 11/2002 Ruttan et al.
2007/0269997 A1 11/2007 Eldridge et al.

FOREIGN PATENT DOCUMENTS

EP 0379176 B1 3/1995
EP 1609342 B1 4/2012
JP 2007180305 A 7/2007
KR 20120097867 A 9/2012
WO 0227867 A2 4/2002

OTHER PUBLICATIONS

Anonymous, "ERmet zeroXT Messerleiste 4-10," Product No. 204406, Feb. 15, 2010. http://www.erni.com/products/connector/204406/.

(Continued)

*Primary Examiner* — Vanessa Girardi
(74) *Attorney, Agent, or Firm* — Katherine Brown

(57) ABSTRACT

A system contains a land grid array socket with a first set of socket interconnections configured to connect to a set of circuit board electrical connectors, each socket interconnection in the first set extending from a top surface to a bottom surface. A second set of socket interconnections are configured to reversibly connect to a set of circuit card electrical connectors. A circuit board can include a mounting surface fastened to the land grid array socket. A set of electrical connectors within a socket connector zone can be connected to at least some of the first set of socket interconnections. A board cutout section is located beneath a second interconnection zone and configured to receive a circuit card.

10 Claims, 6 Drawing Sheets

(56) References Cited

OTHER PUBLICATIONS

Corbin et al., "Land grid array sockets for server applications," IBM Journal of Research and Development, Nov. 2002, pp. 763-778, vol. 46 Issue 6, Riverton, NJ. D.O.I. 10.1147/rd.466.0763.

Yang et al., "Contact Resistance Estimation for Time-Dependent Silicone Elastomer Matrix of Land Grid Array Socket," IEEE Transactions on Components and Packaging Technologies, Mar. 2007, pp. 81-85. D.O.I. 10.1109/TCAPT.2007.892075.

* cited by examiner

SHORT PATH CIRCUIT CARD

BACKGROUND

A packaged integrated circuit may connect to a printed circuit board (PCB) using a land grid array (LGA) socket. Socket interconnections may pass through the socket to electrically connect conductive pads on an integrated circuit package to electrical connectors on a printed circuit board. As the number of wiring channels to an integrated circuit increases, the wiring density beneath a land grid array socket also increases and a circuit board may become thick in order to accommodate the large number of electrical paths or wiring routes that connect to the integrated circuit package.

Integrated circuit packages may provide high speed signal paths at the perimeter of an integrated circuit in order to reduce signal latency and attenuation. Printed circuit boards and LGA sockets that interconnect integrated circuits with printed circuit boards may be designed to accommodate this arrangement of integrated circuit communication pathways.

SUMMARY

Embodiments of the disclosure may be directed toward a system comprising a land grid array socket, a printed circuit board, and a circuit card. The land grid array socket may have a top surface and a bottom surface, with two sets of socket interconnections. The first set of socket interconnections, in a first interconnection zone with a first footprint, may be extend from the top surface to the bottom surface and be configured to connect to a set of circuit board electrical connectors. A second set of socket interconnections, in a second interconnection zone with a second footprint, may extend from the top surface to the bottom surface and be configured to reversibly connect to a set of circuit card electrical connectors. The circuit board may have a mounting surface that is fastened to the bottom side of the land grid array socket. The circuit board may have a set of electrical connectors within a socket connector zone, at least some of the set of electrical connectors connected to at least some of the first set of socket interconnections. The circuit board may also have a board cutout section at least partially located beneath the second interconnection zone and configured to receive the circuit card.

Various embodiments are directed toward a system comprising a circuit board having a board cutout section configured to receive a circuit card and a mounting surface with a socket connector zone. The circuit card may contain a set of circuit board electrical connectors configured to electrically connect with at least some of a first set of socket interconnections in a land grid array socket. The circuit card may be configured to fit within a circuit board cutout section. The circuit card may further have a top side with a card connector zone that contains a set of card electrical connectors that are configured to reversibly connect to at least some of a second set of socket interconnections in a land grid array socket.

Embodiments of the disclosure may also be directed toward a method of reversibly connecting a circuit card to a land grid array socket. The method may include configuring a circuit board with a circuit board cutout section and a plurality of a first type of electrical connector. The method may also include configuring the circuit card with a plurality of a second type of electrical connector and configuring a land grid array socket with two sets of interconnections. A first set of interconnections may be configured to make electrical contact with at least some of the plurality of the first type of electrical connector on the circuit board, while the second set of interconnections may be configured to make electrical contact with at least some of the second type of electrical connector, located on a circuit card. The method may also include mounting the land grid array socket on the circuit board such that the second set of electrical interconnections is above the circuit board cutout section; and at least some of the plurality of the first type of electrical connector and at least some of the first set interconnections form an electrical circuit. The method may also include inserting the circuit card into the printed circuit board cutout section such that at least some of the second set of electrical interconnections form an electrical circuit with at least some of the plurality of the second type of electrical interconnection.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
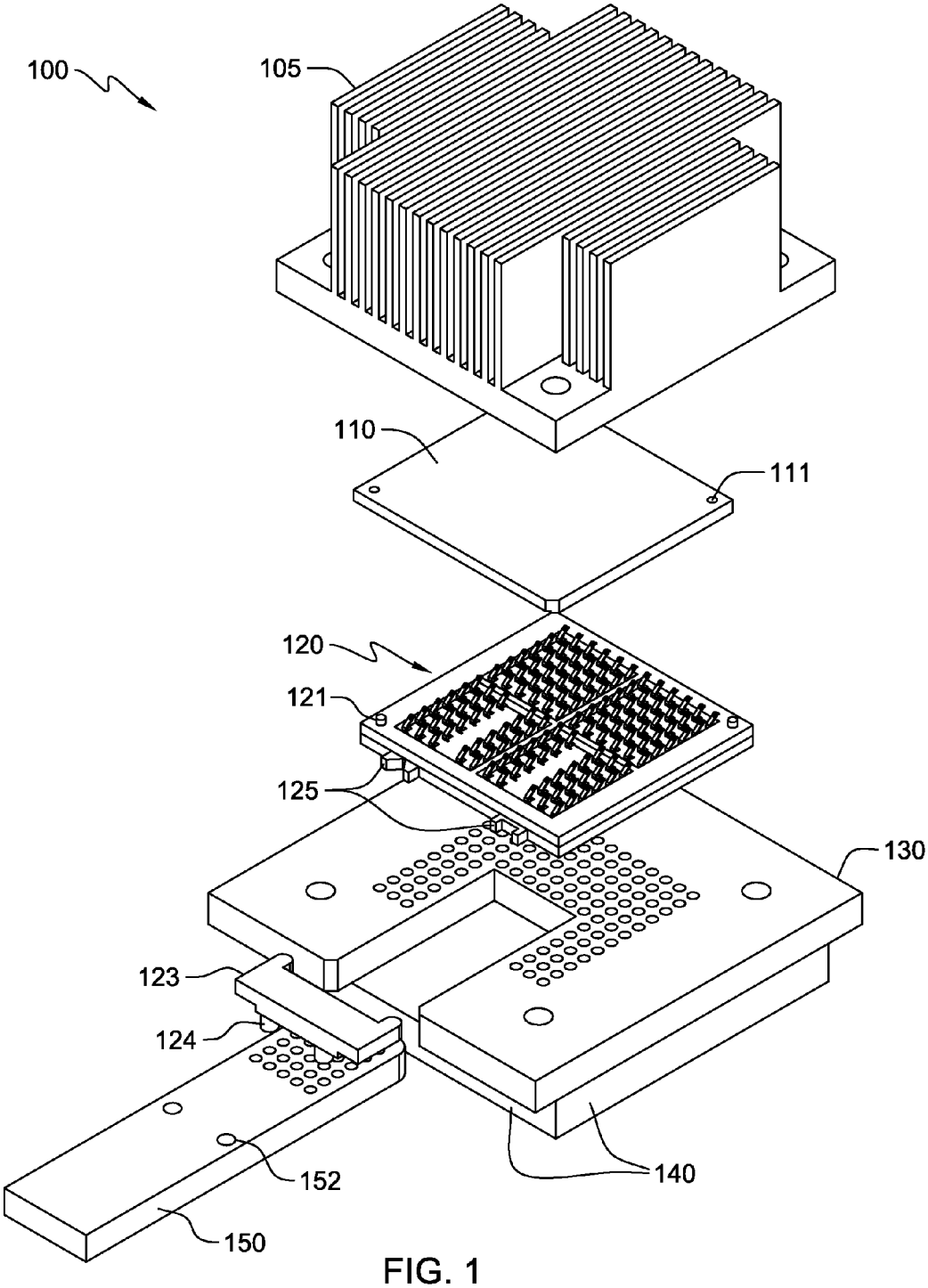
FIG. 1 depicts a stack assembly that includes a printed circuit board, a circuit card, a land grid array socket, and an integrated circuit, according to embodiments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to modifying the design of printed circuit boards and the electrical performance of integrated circuits attached to printed circuit boards using land grid array sockets. More particular aspects of the present disclosure relate to designs of printed circuit boards that may group integrated circuit connections according to their function, especially those carrying high frequency electrical signals between a packaged integrated circuit and cables or other items attached to a printed circuit board (PCB, or "board) or circuit card (or simply a "card"). While the present disclosure is not necessarily limited to such applications, various aspects of the disclosure may be appreciated through a discussion of various examples using this context.

As integrated circuit gate density increases the numbers of electrical connection points on the chips which contain integrated circuits also increases. These greater numbers of electrical connection points can be arranged on smaller computer chips with an increase in the overall density of circuit connections within the chip footprint.

High wiring density or connection point density may pose problems for printed circuit board designers. First, complicated wiring routing beneath an integrated circuit package or LGA socket may introduce long wiring paths with potential for signal attenuation, noise pickup, and high latency. These issues may be more prevalent on wiring paths that carry high frequency signals than on low frequency signal paths or wiring for power delivery between the circuit board and an integrated circuit. Additionally, circuit boards may be quite thick in order to accommodate high wiring density in printed circuit boards.

Consistent with embodiments of the present disclosure, a system can be configured to allow for the use of a separate circuit card (relative to a main PCB that is designed to support an LGA socket) to provide access to signals on an integrated circuit package and the corresponding LGA socket. A set of interconnection structures (or just "interconnections") can be used to allow the circuit card to be inserted into an opening in the main PCB and to make electrical contact with a set of signals in the LGA socket. This can be particularly useful for providing better signal quality for high speed signals that are routed through the inserted circuit card. For instance, the inserted circuit card can be thinner than the main circuit card due to the number of contacts on the circuit card being only a subset of the total contacts for the LGA socket. Moreover, in some embodiments, the inserted circuit card can also be made with a different materials, such as different dielectric materials, different conductive materials and combinations thereof. Alternative dielectric materials and conductive materials may be selected in order to reduce the potential for induced noise in signal-carrying lines or to reduce signal attenuation. The inserted circuit card can also be made with different fabrication techniques than the printed circuit board, such as a sequential build up technology using microvias vs large thru hole vias. In various embodiments, the second circuit card design can be integrated into the design of the I/O cable assembly to reduce the number of interconnect interfaces for improved electrical performance.

To facilitate the use of an inserted circuit card, the connections between a printed circuit board and an integrated circuit can be grouped based on the function that the connections perform. For example, high-frequency signal connections might be clustered into a relatively small contiguous region, while lower-frequency signal connections and power wiring might be clustered into one or more adjacent contiguous regions. Function-based connection clustering may be combined with modified printed circuit board designs to reduce signal attenuation, line noise, and latency.

Embodiments of printed circuit boards may be configured to specifically exclude high-frequency signal connections from the body of the board by placing a cutout section in the printed circuit board below where those connections are located on a LGA socket/integrated circuit package. Instead of routing high-frequency signals through the relatively long wiring paths of a printed circuit board to other computing device components such as computer memory or a communication cable, much shorter paths may be provided by using a specially configured printed circuit card that fits into the circuit board cutout section. Such printed circuit cards may have shorter, simplified routing paths that run through the body of the circuit card or parallel to the card layers until the paths reach the intended component. A high speed data communication connector may be connected almost directly to an integrated circuit in such a configuration, greatly reducing signal latency and attenuation. Furthermore, certain embodiments may be capable of exchanging the intended component (communication connector, etc. . . . ) in the event of hardware failure.

FIG. 1 shows an embodiment of an integrated circuit package stack assembly 100 above a printed circuit board with an insertable card that can make electrical contact with connector points on the bottom of an integrated circuit. High-frequency communication channels that may be sensitive to signal attenuation and susceptible to electrical noise may be clustered into part of an integrated circuit package 110 in order to make connections with a printed circuit card 150 rather than a printed circuit board 130. Such clustering may reduce latency in and attenuation of signals transmitted to and from a component such as a high-speed communication cable attached to the circuit card. Further, such clustering may simplify the task of routing wiring through the printed circuit board under the remainder of the LGA socket 120 and may even reduce the thickness of the circuit board 130.

An integrated circuit package 110 with alignment holes 111 may be placed atop and fastened to a land grid array socket 120. Electrical connection points or conductive pads on the bottom of the integrated circuit package 110 may be positioned and configured to make electrical contact with interconnection structures (or just "interconnections") within the land grid array socket 120. The interconnections in the land grid array socket may extend from the top side to the bottom side of the land grid array socket and permit creation of an electrically conductive path from a printed circuit board 130 to the integrated circuit package 110. Integrated circuit package 110 may be aligned on the land grid array socket 120 using socket alignment pins 121 that fit into alignment holes 111 in the integrated circuit package. Socket alignment pins 121 may also position and align land grid array socket 120 on a printed circuit board 130 in order to ensure that interconnections in the land grid array socket 120 make electrical contact with electrical connectors in the printed circuit board 130. In some embodiments, some of the interconnections in the land grid array socket 120 may have arms or cantilevers configured with spring contact tips at their ends in order to undergo compression as the integrated circuit package 110 and the land grid array socket 120, or the land grid array socket 120 and the printed circuit board 130 are pressed against each other. In other embodiments, some of the interconnections may have balls of solder a fixed to the end of the interconnection in order to form a fixed connection between pieces within the package stack assembly 100. Further embodiments may include socket interconnections with contact pads of different lengths configured to make electrical connections with connectors on a printed circuit board or a circuit card.

Some embodiments may have a section of the printed circuit board configured with a cut out region shaped to receive a printed circuit card 150 with another set of connectors. The connectors on the printed circuit card 150 may be the same type of connectors present on the printed circuit board, or may be a different type of connector, according to the type of LGA socket interconnection to which they may connect. The connections created between the set of connectors on the printed circuit card 150 may be different in character (permanently affixed or reversibly connected) from those created between the set of connectors on the printed circuit board 130 and the interconnections within the land grid array socket above the circuit board connectors.

The printed circuit card 150 may have alignment holes 152 configured to receive card alignment pins 124 on an alignment feature 123. The alignment feature 120 may be mounted on the printed circuit card 150 and have protrusions configured to fit within alignment notches 125 on the land grid array socket that can correctly position the connectors on the printed circuit card 150 under the land grid array socket interconnections to enable communication with the integrated circuit.

The integrated circuit package assembly 100 may have a heatsink 105 that overlies integrated circuit package 110, the land grid array socket 120, and fastens to the printed circuit board 130 to help retain the pieces of the stack in their positions and to remove excess heat from the integrated circuit during normal operation. In some embodiments, a stiffener 140, which may be a monolithic part, may be positioned beneath the integrated circuit package stack on the opposite side of the printed circuit board 130 from the land grid array socket 120. The stiffener 140 may reduce board flexing, twisting, or other stresses which may separate land grid array socket interconnections from printed circuit board connectors or printed circuit card connectors and interrupt the delivery of power or signals between the integrated circuit package 110 and other portions of the computing device in which the printed circuit board 130 is installed. The stiffener 140 may also help to guide and align circuit card connectors with the bottom ends of LGA socket interconnections such as by controlling the vertical positioning of the circuit card electrical connectors from the bottom side of the LGA socket.

Figure 2:
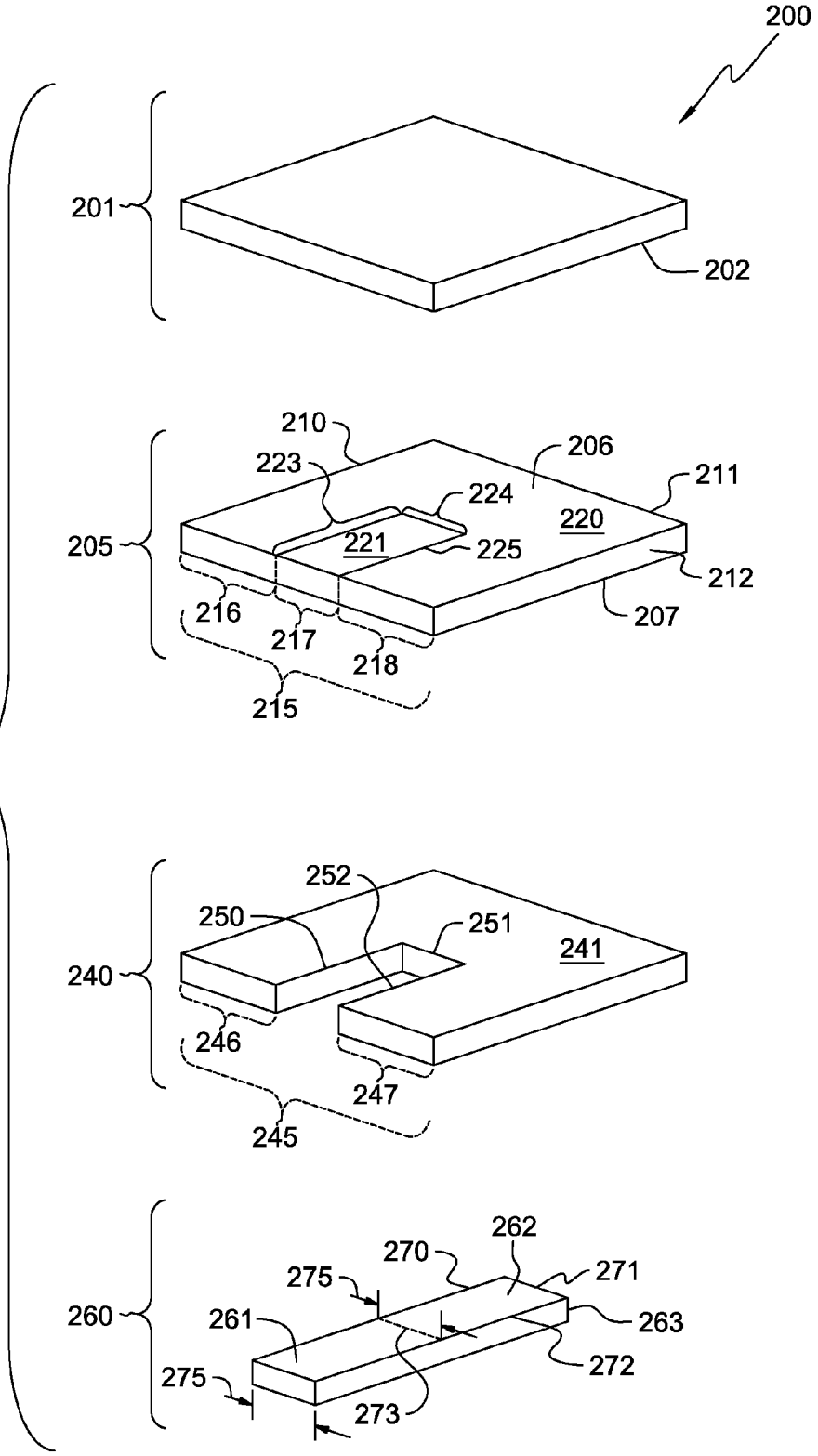
FIG. 2 shows an expanded view of a stack assembly detaining how a circuit card can fit into a circuit board cutout section, according to aspects of the present disclosure.

FIG. 2 shows an expanded view of elements of an integrated circuit package stack assembly 200 according to embodiments of the present disclosure. The stack may include an integrated circuit package 201, a land grid array socket 205, a printed circuit board 240, and a circuit card 260 aligned atop one another and having electrical connections extending from the bottom of the integrated circuit package 201 to the wiring within the printed circuit board 240 and the circuit card 260. The integrated circuit package 201 may have a bottom side 202 placed on the socket top side 206. Conductive pads on the bottom of integrated circuit package 201 may be positioned to make electrical contact with interconnections in the land grid array socket 205 using alignment pins present in the land grid array socket 205. Interconnections in land grid array socket 205 may extend from the socket top side 206 to the socket bottom side 207 and may permit passage of electrical signals through the land grid array socket 205.

Land grid array socket 205 may have a plurality of sides 210, 211, 212, 215 that make up the edges of the socket body. One side 215 may be divided into a first segment 216, a second segment 218, and a third segment 217. The socket top side 206 and the socket bottom side 207 may be divided into different zones according to the function of conductive pads located on the bottom side 202 of the integrated circuit package 201 to which they connect. A first socket zone 220 may follow the edges of the top side 206 and the edges of the bottom side 207 for most of the socket perimeter. A second socket zone 221 may follow just the third segment 217 along the perimeter of the land grid array socket 205 and be delineated from the first socket zone 220 by a first zone border 223, a second zone border 224, and a third zone border 225. According to some embodiments, the second socket zone 221 may be square or rectangular in shape and resemble the size and shape of the printed circuit board 130 cutout section as shown in FIG. 1. The length of the third segment 217 may be the same as the length of the second zone border 224 in some embodiments.

Printed circuit board 240 may have a connection zone 241 on a top side or mounting surface. Printed circuit board 240 may also have an insertion edge 245. Insertion edge 245 may have two edge segments 246 and 247 on opposite sides of a cutout having three cutout sides 250, 251, and 252. The shape of the cutout defined by the three cutout sides 250, 251, and 252 may correspond to the size, shape, and position of a second socket zone 221 in a landing grid array socket 205. The connector zone 241 on the printed circuit board 240 may be configured with a first set of electrical connectors configured to make electrical contact with interconnections in the first socket zone 220. In some embodiments, all of the first set of electrical connectors may make contact with interconnections in the first set of interconnections in the first interconnection zone. In other embodiments, not every electrical connector or interconnection may form an electrical connection.

A circuit card 260 may have a first width 275 along its entire length, including at the insertion end 263. In some embodiments, the circuit card 260 may have the first width only on the part that fits into the printed circuit board cutout section, and a second width at a handling end 261 of the circuit card 260. The circuit card 260 may have a second the connector zone 262 defined on the top side of printed circuit card 260. The second connector zone 262 may be defined by a first card edge 270, a second card edge 271, and a third card edge 272, as well as a line segment 273 having the first width 275 that extends across the top side of the circuit card 260. The second connector zone may contain a second set of electrical connectors which may be flat metallic paths or may include some type of elevated connector structure designed to make contact with interconnections on the socket bottom side 207. The handling end 261 may be used to manipulate the circuit card 260 such as to insert it or to remove it from a cutout section of a printed circuit board. The first width 275 may be approximately the same length as third segment 217 along one side of the land grid array socket 205. The circuit card 260 may have retaining holes similar to the alignment feature retaining holes 152 shown in FIG. 1.

A removable circuit card 260 may be inserted into and withdrawn from the printed circuit board cutout section after the integrated circuit package 201, the land grid array socket 205, and the printed circuit board 240 have been fastened together. In some embodiments the integrated circuit package 200 one may be reversibly fastened to the land grid array socket 205, or it may be permanently fastened to the land grid array socket 205. Permanent fastening may include heating interconnections with solder balls on them to sufficiently high temperatures that the solder balls melt and permanently fasten to at least some of the first set of electrical connectors on the printed circuit board. Circuit card 260 may be characterized in embodiments by the removable nature of the card, where the electrical contacts between the second set of interconnections in the land grid array socket 205 and the second set of electrical connectors in the circuit card 260 may be repeatedly formed and broken by inserting and removing the printed circuit card 260 from the printed circuit board 240 cutout section.

Figure 3:
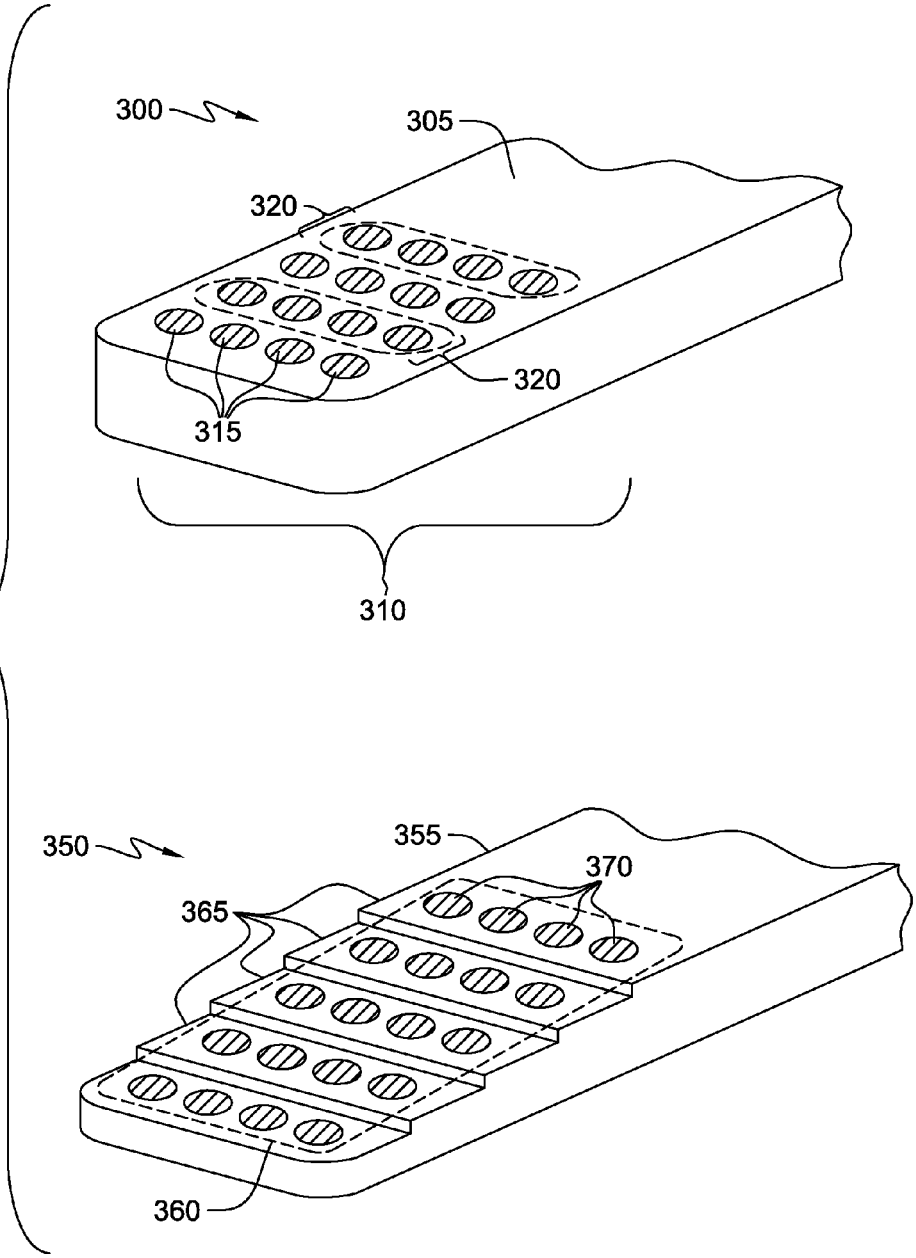
FIG. 3 shows embodiments of circuit cards configured to make electrical connections with land grid array socket interconnections, according to aspects of the present disclosure.

FIG. 3 shows a first circuit card 300 and a second circuit card 350 that may be inserted into a printed circuit board cutout section such as those shown in FIG. 1 and FIG. 2, according to aspects of the present disclosure. The first circuit card 300 may have a top side 305 with a set of electrical connectors 310. A plurality of individual electrical connectors 315 may be arranged in ranks or rows 320 that are configured to make simultaneous electrical connection with a corresponding rank or row of electrical interconnections in the land grid array socket to which the circuit card connects. In certain embodiments, the first circuit card 300 may have a flat top side 305.

In other embodiments, a circuit card 350 may have a top side 355 with a series of staggered elevations 365 that step downward from the highest level of the circuit card toward the leading edge of the circuit card that is inserted into the cutout section of a circuit board beneath a land grid array socket. Each staggered elevations 365 may have a plurality of individual electrical connectors 370 arranged in a rank or row configured to make simultaneous electrical connection with a corresponding rank or row of electrical interconnections in the land grid array socket to which the circuit card connects. The individual electrical connectors on the top side 355 of the circuit card 350 may be arranged in a grid-like pattern within a card connector zone 360. A card connector zone on a flat top side 305 or the card connector zone 360 on a top side 355 with staggered elevations 365 may be located beneath the second connector zone as described in FIG. 2 once the circuit card has been inserted into the circuit board cutout section.

Figure 4:
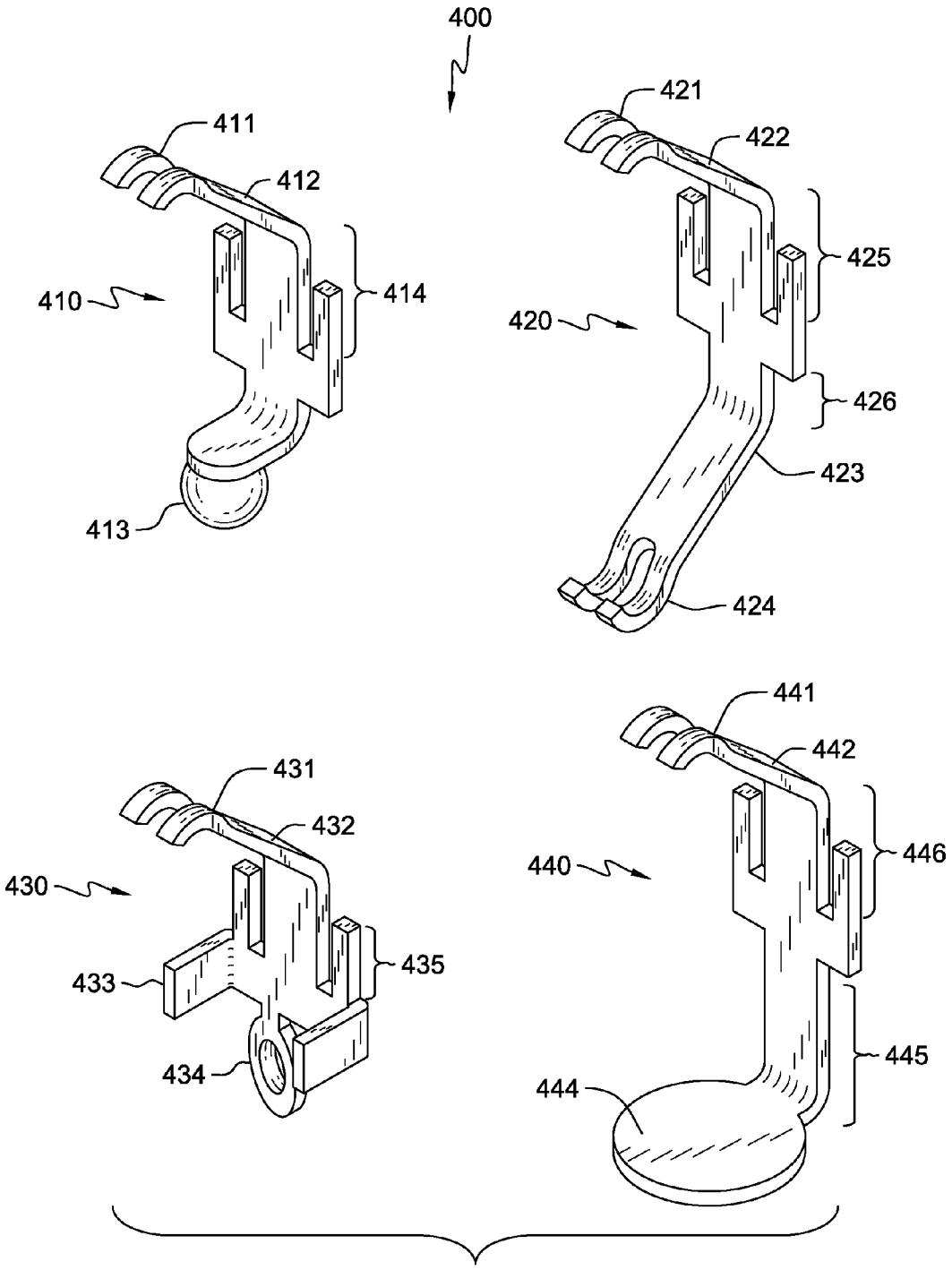
FIG. 4 shows embodiments of land grid array socket interconnections and circuit card connectors according to aspects of the present disclosure.

FIG. 4 shows a set of connecting elements 400 that may be used to form an electrical connection between a printed circuit board or a circuit card and an integrated circuit mounted on the top of a land grid array socket. According to aspects of the present disclosure, a PCB or card may have either flat electrical contacts or electrical connectors (such as pin connector 430) that reach up from the PCB or card to make contact with conductive elements embedded in an LGA socket. Electrical connectors may have a pin end 434 that is inserted into a printed circuit card or circuit board by a pin end to hold the connector in the board or card before the connector is soldered to the board or pin.

Electrical interconnections (such as 410, 420 and 440) in a land grid array socket may extend through the socket body from the top side to the bottom side and make either fixed or temporary connections to electrical connectors in a circuit board or circuit card in order to transfer power and signals between the integrated circuit package and the circuit board or circuit card. A fixed connection may be characterized by lasting fastening methods such as soldering, where solder bumps on some interconnection elements are heated until they melt and flow to form electrical connections that may remain in place without external retaining clips, pins or screws. A temporary connection may be characterized by the use of springy cantilevers, friction, and possibly some form of external retaining clip, pin, or screw to retain a circuit card or circuit board or socket in contact with some other component in the integrated circuit package stack assembly. According to aspects of the present disclosure, the kind of socket interconnections used in a land grid array socket may determine the nature of the electrical connections between the LGA socket and the integrated circuit package, the circuit board, and the circuit card.

In some embodiments, a land grid array socket may make a combination of permanent and temporary connections by using a mixture of different socket interconnections in the body of the socket. According to further aspects of the present disclosure, a land grid array socket may be divided into several interconnection zones, each zone containing a different type of interconnection. Further, each interconnection may be configured to make either a temporary or a permanent electrical connection with either the integrated circuit package or the circuit card or printed circuit board that adjoins the top or bottom side of the LGA socket.

For example, a first interconnection zone on the LGA socket may overlay a printed circuit board with flat electrical contact pads. The socket interconnection may have an upper end configured to make a temporary connection with contact pads on the integrated circuit package using, for example, a cantilever arm with a contact spring tip, while the bottom end of the socket interconnection may be configured to make a permanent connection with the electrical connectors of the printed circuit board with solder balls at the tip of the bottom end that are melted to and fuse with the electrical connectors on the circuit board.

A second interconnection zone may overlay a cutout section in the printed circuit board and contain a second type of interconnection configured make a temporary connection with both the integrated circuit package and the circuit card. For example, the second type of interconnection may have a cantilever with a first spring tip on the top end and another cantilever with a second spring tip on the bottom end. The first spring tip may make electrical contact with an integrated circuit contact pad and the second spring tip may make contact with an electrical connector or contact pad on the circuit pad beneath the second interconnection zone of the LGA contact. In other embodiments, an interconnection in an LGA socket may make removable contact (forming a temporary connection) with a cantilever having a spring tip to allow repeated formation of electrical connections or the separation of the LGA socket with the circuit board or circuit card. A discussion of the structural elements of examples of one or more interconnections and connectors follows.

A pin connector 430 may be inserted into a printed circuit board or a circuit card to enable an electrical circuit with a land grid array socket placed atop the circuit board or circuit card. Pin connector 430 has a pin 434 on one end which may be inserted into the body of the circuit board or circuit card to hold it in place until the connector can be permanently fastened to the circuit board. In some embodiments, solder may help to fasten the pin to the circuit card or circuit board. Fixed or permanent fastening may be accomplished by applying solder at the juncture of the pin connector solder foot 433 (there may be one or two solder feet on each pin connector) and a conductive pad on the circuit board or circuit card.

Pin connector 430 may also have an elevation section 435. The elevation section 435 may have different lengths according to different embodiments of the connector. Some elevation sections 435 may be short, while others may be longer, in order to accommodate different embodiments of land grid array socket interconnections. The pin connector elevation section 435 may, upon bending, become a cantilever 432 with a spring contact tip 431. The length of the cantilever may be configured such that the spring contact tip 431 makes contact with a predetermined interconnection that extends from a land grid array socket.

A ball-cantilever interconnection 410 may have a ball grid array contact 413 consisting of a solder ball fastened one end of the interconnection and a cantilever with a sprint contact tip at the other end of the interconnection. A ball grid array contact 413 may be used in a land grid array socket in order to create a fixed electrical connection between the interconnection and an integrated circuit package or a printed circuit board bring to aspects of the present disclosure. Like the pin connector 430, a ball-cantilever interconnection 410 may have an elevation section 414 next to the cantilever which may have different lengths in the various embodiments of the interconnection. The different lengths of an elevation section may be used to position a cantilever 412 and spring contact tip 411 at predetermined heights above or below a surface of a land grid array socket.

A dual cantilever interconnection 420 with an upper end having one cantilever arm that extends upwards to the integrated circuit package, and a lower end having one cantilever arm that extends downward toward a circuit board or circuit card, may be used in some embodiments. The upper end of the interconnection may have an elevation section 425 and the lower end may have an offset section 426, the upper end and lower end being attached by a center section that remains in the body of the land grid array socket. According to aspects of the present disclosure, the elevation section 425 and the offset section 426 may each have different lengths according to the configuration of the electrical connectors or integrated circuit package that may connect with the land grid array socket interconnections. The top end of the dual cantilever interconnection 420, connected to the elevation section 425, may have a cantilever 422 and a spring contact tip 421, and the bottom end may have an offset section 426, another cantilever 423 and another spring contact top 424. The length of the elevation section 425 and the length of the offset section 426 may be configured independently in different embodiments of the dual cantilever interconnection 420 to accommodate different land grid array socket designs, different integrated circuit package designs, and different configurations of printed circuit boards and circuit cards.

Another type of interconnection, a pad interconnection 440, may be used in some embodiments. A pad interconnection 440 may have an elevation section 446 and an offset section 445, each of which may have a length configured to match with the configuration of an integrated circuit package and printed circuit board or printed circuit card in the stack assembly. A pad interconnection 440 may have a contact pad 444 at the end of offset section 445. Offset section 445 may be connected to elevation section 446, and the cantilever 442 on the top side of the pad interconnection 440 may begin at the point where the elevation section 446 bends away from a vertical direction. The cantilever 442 may end in a sprint contact tip 441 that has been configured to make contact with an integrated circuit package placed atop a land grid array socket that contains the pad interconnection 440.

In some embodiments, a pin connector 430 may be inserted into a printed circuit board or a circuit card and may make electrical contact with a contact pad 444 in a pad interconnection 440 on the bottom side of the LGA socket. The length of an offset section 445 in a pad interconnection 440 and the length of an elevation section 435 in a pin connector 430 may be configured prior to creation of the stack in order to form electrical circuits in the stack. In other embodiments, dual-cantilever interconnection 420 and ball-cantilever interconnection 410 may be used in land grid array sockets instead of a pad interconnection 440. These three embodiments of land grid array socket interconnections and the pin connector 430 merely illustrate examples of pins, connectors or interconnections that can be used to form connections between circuit boards, circuit cards, sockets, and integrated circuit packages. All other embodiments that create electrical connections in the circuit board/socket/integrated circuit stack are also covered by this disclosure.

Figure 5:
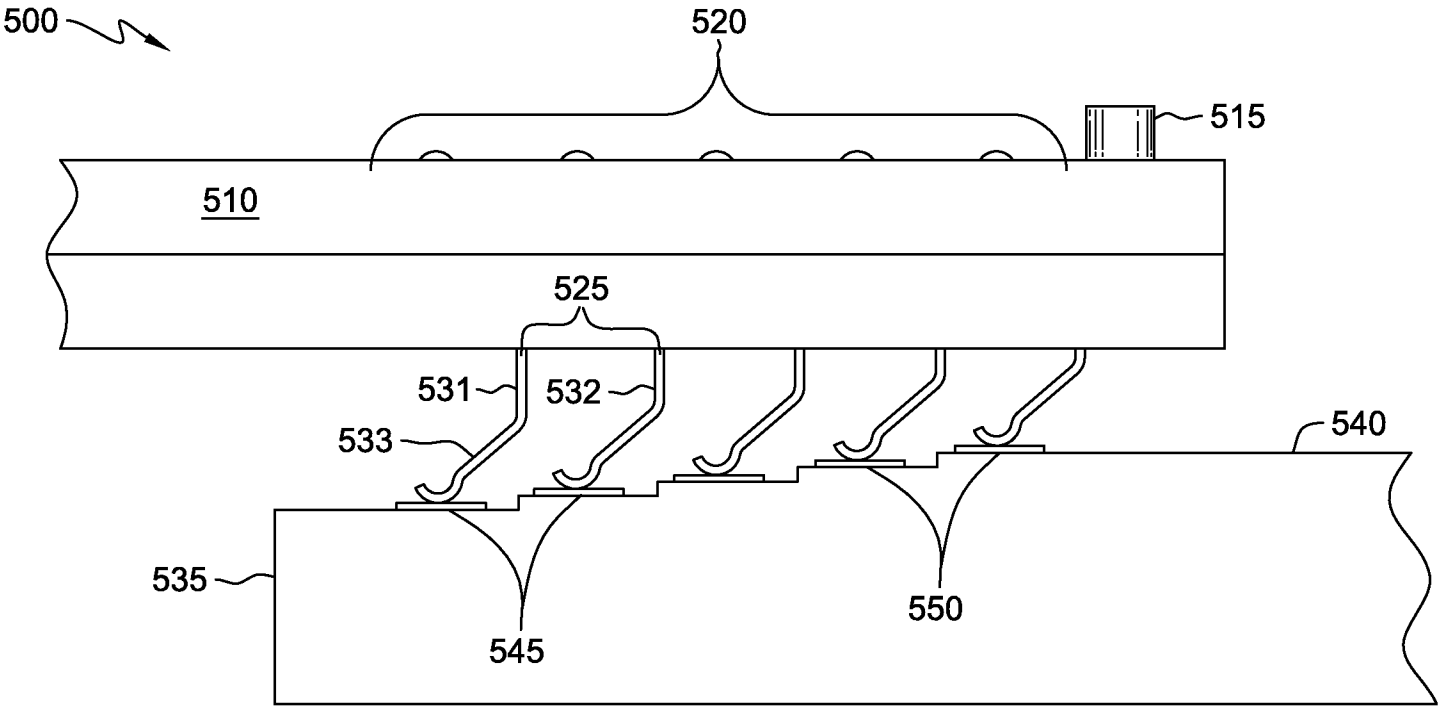
FIG. 5 shows a profile view of a staggered-elevation circuit card with electrical connectors on the staggered elevations making contact with a land grid array socket interconnections, according to embodiments.

FIG. 5 shows a profile view 500 of an embodiment of a staggered-elevation circuit card that forms electrical connections with a land grid array socket according to aspects of the present disclosure. A land grid array socket 510 may contain a first set of socket interconnections 520 that extend through the socket from the top side to the bottom side of the socket. The land grid array socket 510 may have at least one alignment pin 515 or other feature configured to position an integrated circuit package atop the socket to such that individual socket interconnections align with electrical pads on the bottom of the integrated circuit package. Socket interconnections 525 that extend below the land grid array socket may have different lengths offset sections. For example, in some embodiments offset sections 531 of socket interconnections in a first row may be longer than offset sections 532 in a second row of a socket zone 520. When offset sections 531 and 532 have different lengths, the length of cantilever 533 may be the same for each socket interconnection in the socket zone.

A circuit card 535 may have a top side 540 with a plurality of staggered elevations 545. Each of the staggered elevations 545 may have rows of electrical connectors 550 which may be metallic pads or metallic contacts set nearly flush to the surface of the top side 540 or staggered elevation 545 where the contact is located. In some embodiments, the circuit card 535 may be inserted into a circuit board cutout section beneath the land grid array socket. The staggered elevations 545 and the socket interconnections with different length offset sections may create electrical connections when the circuit card is in a final position by allowing connectors and interconnections to pass by each other during the insertion process.

Figure 6:
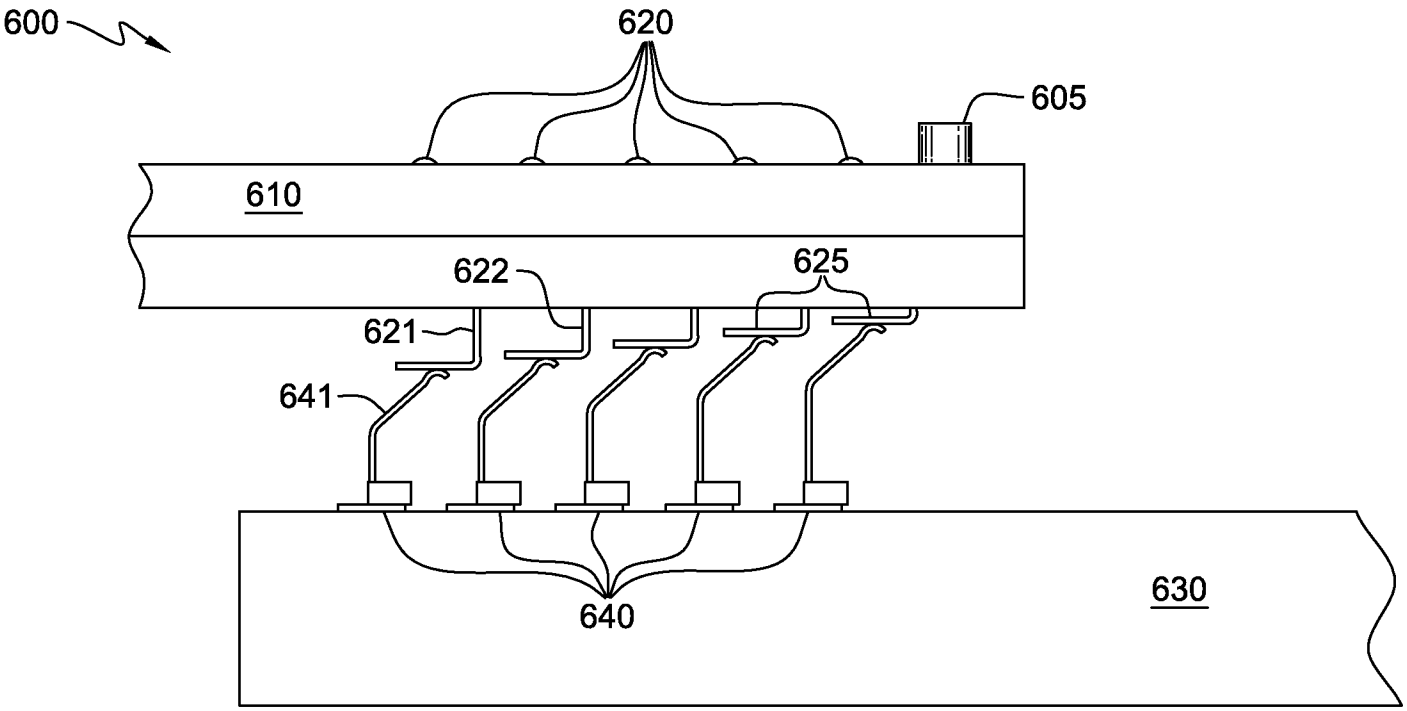
FIG. 6 illustrates a profile view of electrical connectors on a flat-surface circuit card making electrical connections with pad-cantilever interconnections in a land grid array socket according to embodiments.

FIG. 6 shows a cross section 600 of a land grid array socket electrically connected to a circuit card, according to aspects of the present disclosure. A land grid array socket 610 having an alignment pin 605 may contain a set of electrical interconnections 620 that extend from the top side to the bottom side of the socket. The electrical interconnections may have contact pads 625 on their bottom ends. The contact pads 625 in the set of electrical interconnections 620 may be configured to make contact with a set of electrical connectors 640 located on a circuit card 630.

An electrical connector may have a cantilever 641 with a contact spring tip at the end designed to make an electrical circuit with a contact pad 625 on a socket interconnection. Each electrical interconnection in a first row of interconnections may have contact pads at the end of an offset section 621 with a first length. Similarly, each interconnection in a second row of interconnections may have a contact pad at the end of an offset section 622 with a second length. The first length and the second length may be configured to make electrical contact with electrical connectors having different lengths only when the circuit card is fully inserted beneath the LGA socket. The circuit card with staggered elevations shown in FIG. 6 and the circuit card with a flat top side shown in FIG. 5 may each be configured to create electrical circuits only when the circuit cards are fully inserted into circuit board cutout sections by taking advantage of rows of connectors and interconnections that have complimentary elevation section and offset section lengths, regardless of whether the interconnections have contact pads or cantilevered designs. In some embodiments, a staggered elevation circuit card may be used with electrical connectors that all have identical elevation section lengths so long as the offset section lengths of the land grid array socket interconnections are configured to make electrical circuits with the circuit card upon full card insertion.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A system, comprising:

a circuit board having:

a board cutout section configured to receive a circuit card; and a mounting surface with a socket connector zone containing a set of circuit board electrical connectors configured to electrically connect with at least some of a first set of socket interconnections in a land grid array socket; and a circuit card configured to fit in the board cutout section and having:

a top side with a card connector zone; and a set of card electrical connectors within the card connector zone and configured to reversibly connect to at least some of a second set of socket interconnections in a land grid array socket.

2. The system of claim 1, further comprising:

a land grid array socket having a top surface;

a bottom surface;

a first interconnection zone with a first footprint and containing the first set of socket interconnections configured to connect to the set of circuit board electrical connectors, each socket interconnection in the first set extending from the top surface to the bottom surface; and a second interconnection zone with a second footprint and containing the second set of socket interconnections configured to reversibly connect to the set of circuit card electrical connectors, the second set of socket interconnections extending from the top surface to the bottom surface.

3. The system of claim 1, wherein at least some of the socket interconnections have a cantilever with a spring tip configured to make electrical contact with contacts and contact pads and a solder ball configured to make electrical contact with an electrical contact.

4. The system of claim 1, wherein at least some of the socket interconnections have two cantilevered ends configured to make electrical connections with electrical contacts and contact pads.

5. The system of claim 1 wherein a top side of the circuit card has staggered elevations upon which the first type of electrical connectors are mounted.

6. A system comprising:

a land grid array socket having a top surface;

a bottom surface;

a first set of socket interconnections in a first interconnection zone with a first footprint, configured to connect to a set of circuit board electrical connectors, each socket interconnection in the first set extending from the top surface to the bottom surface; and a second set of socket interconnections in a second interconnection zone with a second footprint and containing configured to reversibly connect to a set of circuit card electrical connectors, the second set of socket interconnections extending from the top surface to the bottom surface; and a circuit board with a mounting surface fastened to the bottom surface of the land grid array socket and having:

a set of electrical connectors within a socket connector zone, with at least some of the set of electrical connectors connected to at least some of the first set of socket interconnections; and a board cutout section at least partially located beneath the second interconnection zone and configured to receive a circuit card.

7. The system of claim 6, further comprising:

the circuit card within the board cutout section and having:

a top side with a card connector zone; and a set of card electrical connectors within the card connector zone, where at least some of the card electrical connectors reversibly connected to at least some of the second set of socket interconnections.

8. The system of claim 7, wherein at least some of the socket interconnections have two cantilevered ends configured to make electrical connections with electrical contacts and contact pads.

9. The system of claim 7, wherein at least some of the socket interconnections have a cantilever with a spring tip configured to make electrical contact with contacts and contact pads and a solder ball configured to make electrical contact with an electrical contact.

10. A method of reversibly connecting a circuit card to a land grid array socket, comprising:

configuring a circuit board with a circuit board cutout section and a plurality of a first type of electrical connector;

configuring the circuit card with a plurality of a second type of electrical connector;

configuring a land grid array socket with:

a first set of interconnections configured to make electrical contact with at least some of the plurality of the first type of electrical connector; and a second set of interconnections configured to make electrical contact with at least some of the plurality of the second type of electrical connector;

placing the land grid array socket on the circuit board such that:

the second set of electrical interconnections is above the circuit board cutout section; and at least some of the plurality of the first type of electrical connector and at least some of the first set interconnections form an electrical circuit; and inserting the circuit card into the printed circuit board cutout section such that at least some of the second set of electrical interconnections form an electrical circuit with at least some of the plurality of the second type of electrical interconnection.

* * * * *